US005483725A

United States Patent [19]

Lehman

[11] Patent Number: 5,483,725

[45] Date of Patent: Jan. 16, 1996

[54] SELF-SUPPORTED CHIMNEY SWEEPING DEVICE

[76] Inventor: James O. Lehman, P.O. Box 114, Spruce Head, Me. 04859

[21] Appl. No.: 336,915

[22] Filed: Nov. 10, 1994

[51] Int. Cl.[6] ..... F23J 3/00

[52] U.S. Cl. ..... 15/249.1; 15/104.067; 15/104.2

[58] Field of Search ..... 15/249.1, 249.2, 15/162, 163, 242, 243, 104.16, 104.15, 104.31, 104.2, 104.066, 104.067, 104.068, 104.069; 126/16; 166/170

[56] References Cited

U.S. PATENT DOCUMENTS

| | | | |
|---|---|---|---|
| 2,293,847 | 8/1942 | Pearson | 15/249 |
| 4,409,703 | 10/1983 | Marcellus | 15/243 |
| 4,538,317 | 9/1985 | Sorensen | 15/163 |
| 4,807,320 | 2/1989 | Labrecque | 15/243 |

FOREIGN PATENT DOCUMENTS

| | | | |
|---|---|---|---|
| 537235 | 10/1931 | Germany | 15/163 |
| 119433 | 7/1918 | United Kingdom | 15/249 |

*Primary Examiner*—Gary K. Graham

[57] ABSTRACT

A chimney sweep comprising a square support bracket, a fastening means securely fastening the square support bracket to a top of a chimney, four gussets, each of which is welded to an angle of the square support bracket, the four gussets serving to prevent the square support bracket from sliding down the chimney; two diagonal supports, each diagonal support having a first end and a second end, each first end pivotally secured to an opposite corner of the square support bracket, each second end diagonally secured above the center of the square support bracket forming an upper pivotal element; a pulley system securely coupled with the upper pivotal element, a cable having a first end and a second end; and a hollow brush attachment having an upper support and a lower support, the upper support secured to the first end of the cable of the pulley system, the lower support secured to the second end of the cable of the pulley system, the hollow brush attachment having a series of rigid bristles thereattached.

5 Claims, 5 Drawing Sheets

Fig. 3
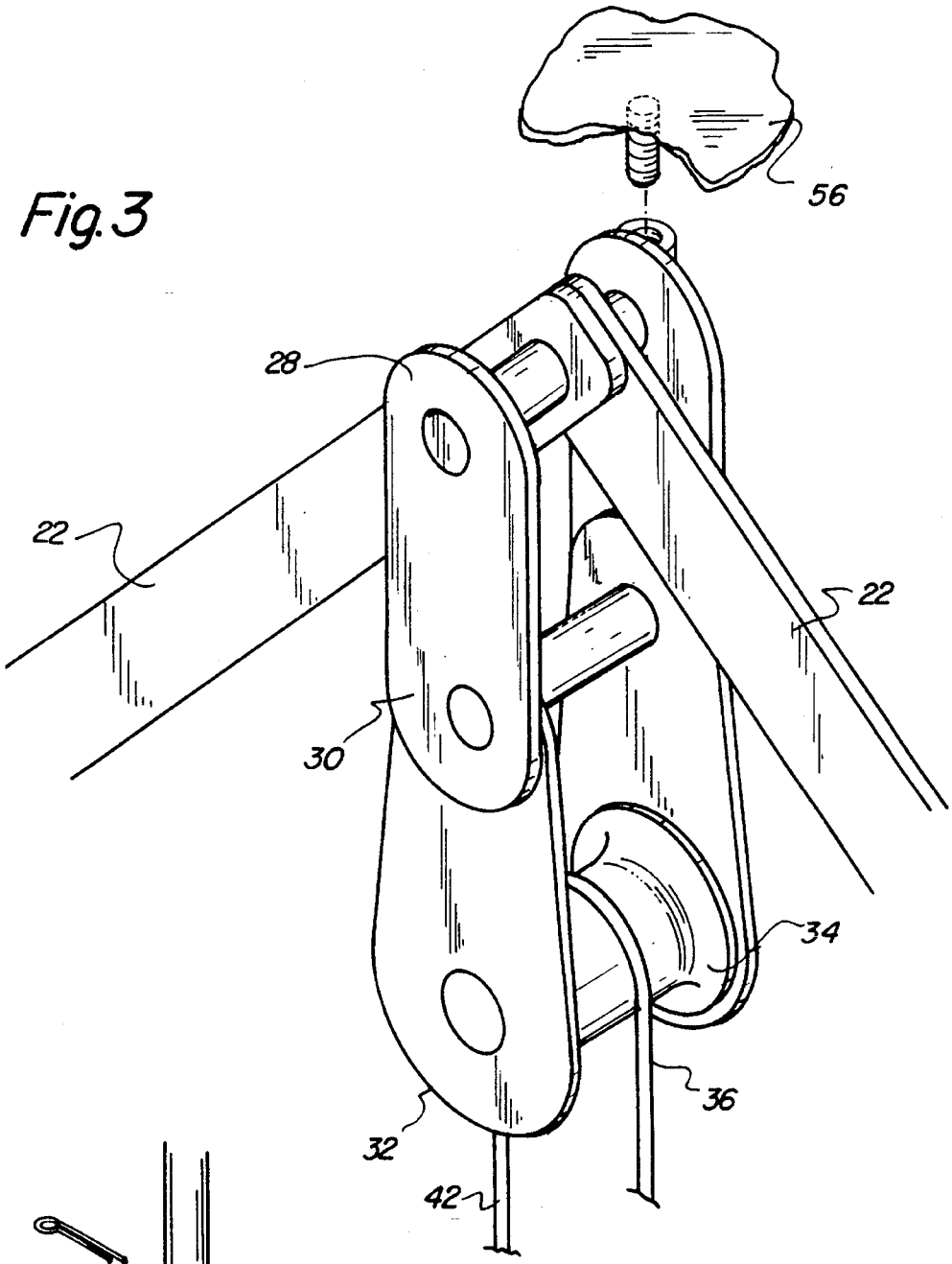
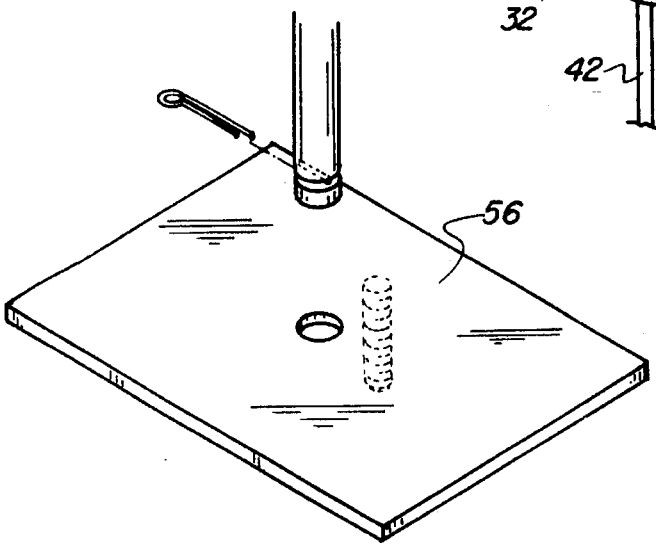
Fig. 4

Fig. 5
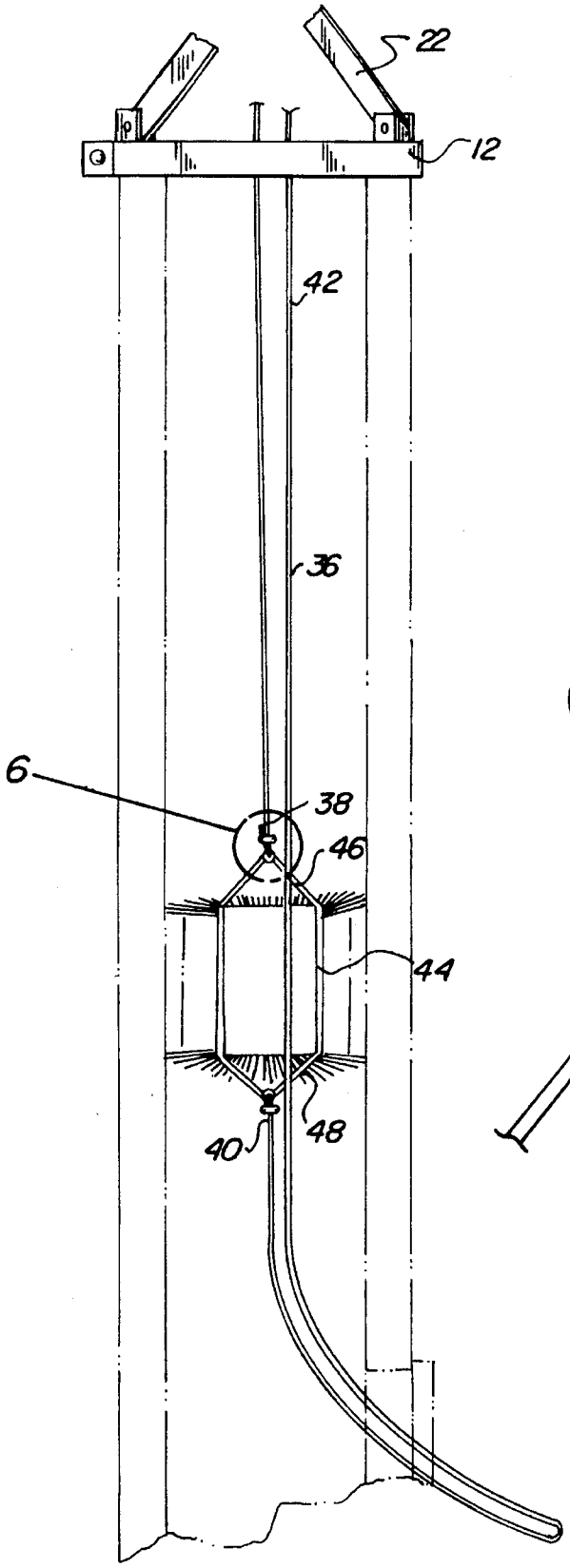
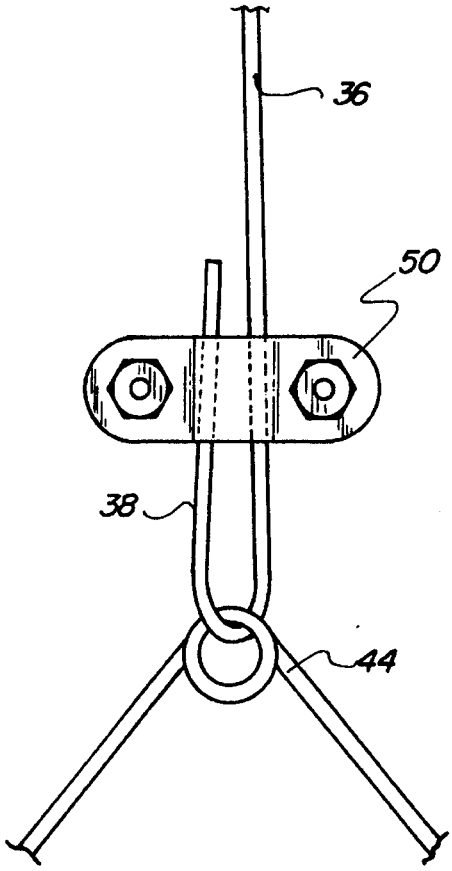
Fig. 6

SELF-SUPPORTED CHIMNEY SWEEPING DEVICE

BACKGROUND OF THE INVENTION

1. Field of the Invention

The present invention relates to a new and improved chimney sweep and, more particularly, pertains to building a cleaning system right into a chimney that can be used from inside or outside of a house.

2. Description of the Prior Art

The use of chimney sweeps is known in the prior art. More specifically, chimney sweeps heretofore devised and utilized for the purpose of cleaning a chimney are known to consist basically of familiar, expected, and obvious structural configurations, notwithstanding the myriad of designs encompassed by the crowded prior art which has been developed for the fulfillment of countless objectives and requirements. The prior art discloses a large number of chimney sweeps. By way of example, U.S. Pat. No. 4,747,177 to Drechsel discloses a chimney sweep system with a scraping assembly.

U.S. Pat. No. 4,619,011 to Grooms discloses a mechanical chimney sweep including a spark arrester.

U.S. Pat. No. 4,254,528 to Souliere discloses a chimney sweeping device with two sets of bristles interconnected.

U.S. Pat. No. 4,817,232 to Bardunias discloses an easy chimney sweep designed to enable anyone to clean his or her own chimney.

Lastly, U.S. Pat. No. Des. No. 266,972 to Bolt discloses the design of a chimney sweep bush.

While these devices fulfill their respective, particular objective and requirements, the aforementioned patents do not describe a chimney sweep that builds a cleaning system right into a chimney that can be used from inside or outside of a house.

In this respect, the chimney sweep according to the present invention substantially departs from the conventional concepts and designs of the prior art, and in doing so provides an apparatus primarily developed for the purpose of building a cleaning system right into a chimney that can be used from inside of a house with a chimney sweep.

Therefore, it can be appreciated that there exists a continuing need for a new and improved chimney sweep which can be used for building a cleaning system right into a chimney that can be used from inside or outside of a house. In this regard, the present invention substantially fulfills this need.

SUMMARY OF THE INVENTION

In view of the foregoing disadvantages inherent in the known types of chimney sweeps now present in the prior art, the present invention provides a new and improved chimney sweep. As such, the general purpose of the present invention, which will be described subsequently in greater detail, is to provide a new and improved chimney sweep and methods which have all the advantages of the prior art and none of the disadvantages.

To attain this, the present invention essentially comprises a new and improved chimney sweep by building a cleaning system right into a chimney that can be used from inside or outside of a house comprising, in combination, a square support bracket formed by three straight sidewalls and one securing sidewall, a fastening means coupled with the securing sidewall to securely fasten the square support bracket to a top of a chimney, four gussets, each of which is welded to an angle of the square support bracket, the four gussets serving to prevent the square support bracket from sliding down the chimney; two diagonal supports, each diagonal support having a first end and a second end, each first end pivotally secured to an opposite corner of the square support bracket, each second end diagonally secured above the center of the square support bracket forming an upper pivotal element, the upper pivotal element having a lower section disposed therebelow; a pulley system comprising a pulley element securely coupled with the lower section of the upper pivotal element, a cable having a first end, a second end, and an intermediate extent therebetween, the intermediate extent located within the pulley element; a hollow brush attachment having an upper support and a lower support, the upper support secured to the first end of the cable of the pulley system by a fastening means, the lower support secured to the second end of the cable of the pulley system by a fastening means, the hollow brush attachment having a series of rigid bristles thereattached; and a wind vane having a mounting bracket, the mounting bracket secured to the upper pivotal element, the wind vane serving to enhance the beauty of the device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved chimney sweep which has all the advantages of the prior art chimney sweeps and none of the disadvantages.

It is another object of the present invention to provide a new and improved chimney sweep which may be easily and efficiently manufactured and marketed.

It is a further object of the present invention to provide a new and improved chimney sweep which is of a durable and reliable construction.

An even further object of the present invention is to provide a new and improved chimney sweep which is susceptible of a low cost of manufacture with regard to both materials and labor, and which accordingly is then susceptible of low prices of sale to the consuming public, thereby making such a chimney sweep economically available to the buying public.

Still yet another object of the present invention is to provide a new and improved chimney sweep which provides in the apparatuses and methods of the prior art some of the advantages thereof, while simultaneously overcoming some of the disadvantages normally associated therewith.

Even still another object of the present invention is to provide a new and improved chimney sweep for building a cleaning system right into a chimney that can be used from inside or outside of a house.

Lastly, it is an object of the present invention to provide a chimney sweep comprising a square support bracket, a fastening means securely fastening the square support bracket to a top of a chimney, four gussets, each of which is welded to an angle of the square support bracket, the four gussets serving to prevent the square support bracket from sliding down the chimney; two diagonal supports, each diagonal support having a first end and a second end, each first end pivotally secured to an opposite corner of the square support bracket, each second end diagonally secured above the center of the square support bracket forming an upper pivotal element; a pulley system securely coupled with the upper pivotal element, a cable having a first end and a second end; and a hollow brush attachment having an upper support and a lower support, the upper support secured to the first end of the cable of the pulley system, the lower support secured to the second end of the cable of the pulley system, the hollow brush attachment having a series of rigid bristles thereattached.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an enlarged perspective view of the present invention.

FIG. 4 is an enlarged perspective view of the wind vane configuration.

FIG. 5 is a cross-sectional view as seen along line 5—5 of FIG. 1.

FIG. 6 is an enlarged front view of the cable and cable clamp of the present invention.

The same reference numerals refer to the same parts throughout the various Figures.

DESCRIPTION OF THE PREFERRED EMBODIMENT

Figure 1:
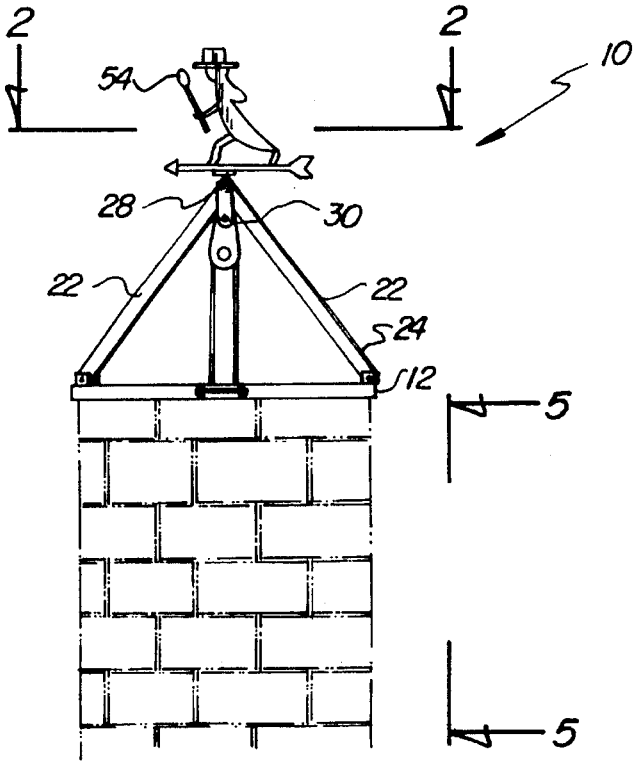
FIG. 1 is a perspective view of the preferred embodiment of the chimney sweep constructed in accordance with the principles of the present invention.
Figure 2:
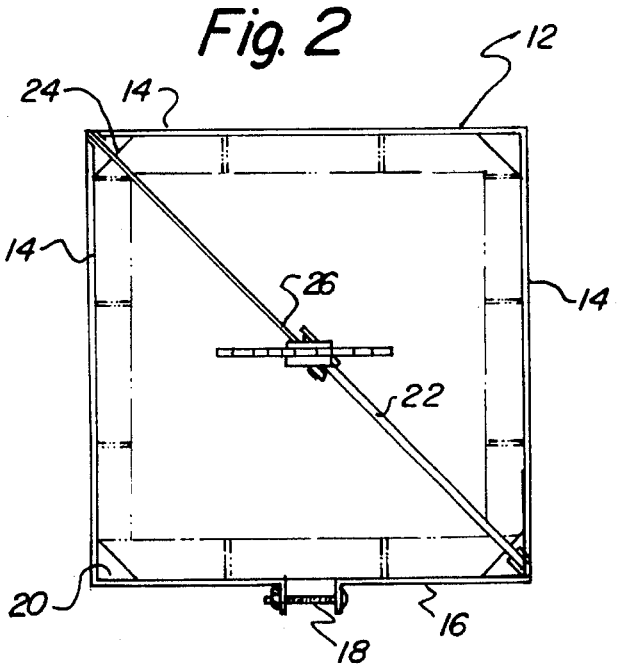
FIG. 2 is a plan view as seen along line 2—2 of FIG. 1.

With reference now to the drawings, and in particular to FIG. 1 thereof, the preferred embodiment of the new and improved chimney sweep embodying the principles and concepts of the present invention and generally designated by the reference numeral 10 will be described.

The present invention, the new and improved chimney sweep is a system 10 comprised of a plurality of components. Such components, in their broadest context, include a square support bracket, two diagonal supports, a pulley system, a hollow brush attachment, and a wind vane. Each of the individual components is specifically configured and correlated one with respect to the other so as to attain the desired objectives.

A square support bracket 12 is formed by three straight sidewalls 14 and one securing sidewall 16. A fastening means 18 is coupled with the securing sidewall 16 to securely fasten the square support bracket 12 to a top of a chimney. The device 10 contains four gussets 20, each of which is welded to an angle of the square support bracket 12. The four gussets 20 serve to prevent the square support bracket 12 from sliding down the chimney. The four gussets 20 are a precautionary measure for the device 10, the fastening means 18 could solely prevent the square support bracket 12 itself from sliding down the chimney.

The device 10 contains two diagonal supports 22. Each diagonal support 22 has a first end 24 and a second end 26. Each first end 24 is pivotally secured to an opposite corner of the square support bracket 12. Each second end 26 is diagonally secured above the center of the square support bracket that form an upper pivotal element 28. The upper pivotal element 28 has a lower section 30 disposed therebelow. The two diagonal supports 22 together form a V-shape over the square support bracket 12.

A pulley system 32 is comprised of a pulley element 34 that is securely coupled with the lower section 30 of the upper pivotal element 28. The device 10 contains a cable 36 having a first end 38, a second end 40, and an intermediate extent 42 therebetween. The intermediate extent 42 is located within the pulley element 34. The cable 36 should be easily propelled within the pulley system 32.

Figure 10:
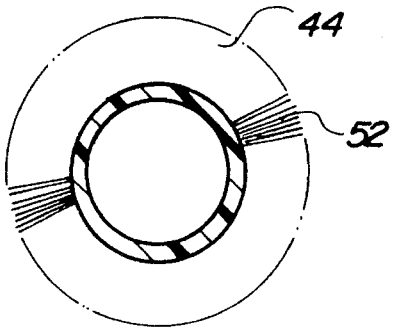
FIG. 10 shows a cross section of the hollow brush attachment along line 10—10 of FIG. 9.

The device 10 further contains a hollow brush attachment 44 having an upper support 46 and a lower support 48. The upper support 44 is secured to the first end 38 of the cable 36 of the pulley system 32 by a fastening means 50. The lower support 48 is secured to the second end 40 of the cable 36 of the pulley system 32 by a fastening means 50. As shown in FIG. 10, the hollow brush attachment 44 has a series of rigid bristles 52 thereattached. The fastening means 50 is comprised more specifically of a cable clamp and a loop secured to the upper support 46 and the lower support 48.

Lastly, the device 10 contains a wind vane 54 having a mounting bracket 56. The mounting bracket 56 is secured to the upper pivotal element 28. The wind vane 54 serves to enhance the beauty of the device 10.

Figure 7:
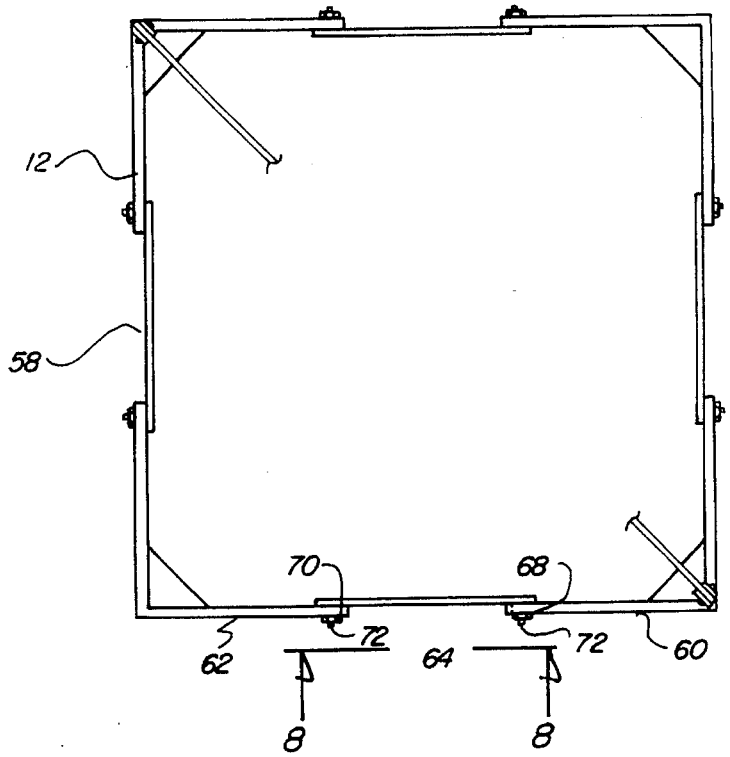
FIG. 7 is a plan view of the second embodiment of the present invention.
Figure 8:
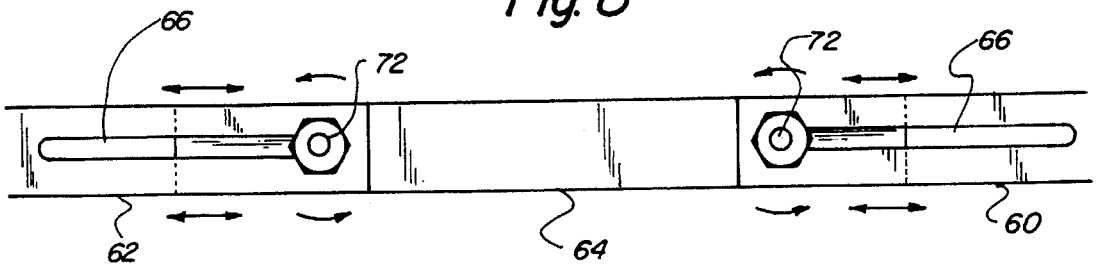
FIG. 8 is a cross-sectional view as seen along line 8—8 of FIG. 7.
Figure 9:
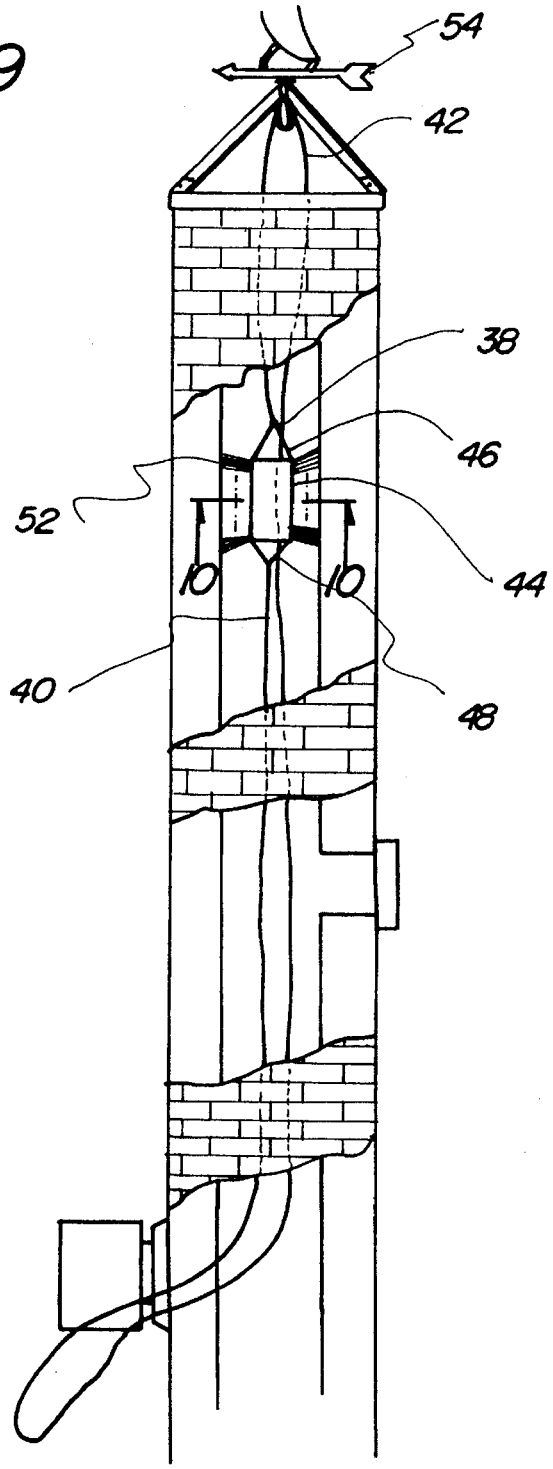
FIG. 9 shows the chimney with the brush attachment supported therein for cleaning.

A second embodiment of the present invention is shown in FIGS. 7 and 8 and includes substantially all of the components of the present invention further including wherein the square support bracket 12 has four sidewalls 58. Each sidewall 58 has a right section 60, a left section 62, and an intermediate section 64 therebetween. Oblong apertures 66 are formed in each right section 60 and each left section 62. Each intermediate section 64 has a right edge 68 and a left edge 70. A bolt 72 is secured to each right edge 68 and each left edge 70. Each bolt 72 is adjustably coupled with each oblong aperture 66 of each right section 60 and each left section 62. Each bolt 72 functions to adjust the size of each sidewall 58 of the square support bracket 12 to better fit a chimney. Specifically, each sidewall 58 can adjust between sixteen inches and twenty-four inches.

Perhaps the most important point of the present invention is the use of a hollow housing 44 with the bristles extending radially outward therefrom. This arrangement allows the pull up cable to extend vertically down the center of the chimney through the housing with the operator manipulating the cleaning movement from a lower orientation. In the past, such movement of brush was effected from above the chimney. This was a problem in that it required the operator to work from the roof. The present invention allows cleaning from the lower location for the very first time. It also allows cleaning from interior of the house and even while a fire is burning in the stove.

Another important feature of the present invention is that the particular cleaning device is capable of being stored in the chimney at a location beneath the lowest stove input. When in such storage position, those cables which had been extending out of the clean out door are simply coiled up and placed inside the chimney at the lower location adjacent to the cleaning device and the door is then closed. The cleaning device is then in position for its next use when desired.

In this regard, the cables are preferably made of a flexible stainless steel material which is impervious to normal flue temperatures which allows them to remain inside the chimney at all times even when in the storage orientation.

Chimneys require maintenance or they clog with soot and ash and become fire hazards. In addition, the soot can make it difficult for smoke to escape out of the chimney, causing it to back up into the house or building. Consequently, home and building owners must schedule regular maintenance with a chimney sweep, who will clean out the chimney for a fee.

The present invention replaces the need for a professional by building a cleaning system right into the chimney. The system consists of a basic pulley with a brush attachment. The pulley is installed at the top of the chimney and a strong cable is attached to the brush with two cable clamps at the top and bottom of the brush.

The brush could come in several different shapes including rectangular, round, or square to accommodate flues with different sizes and shapes. As the brush is pulled up through the flue, debris passes through a hollow opening in the center and down to the bottom, where it can be collected through a clean-out door or other access located at the base of the chimney.

The present invention does have some specific requirements. The chimney must be able to accept or accommodate a framework that can support a pulley system above the flue outlet at the top of the chimney. It is essential that the pulley be mounted high enough for the brush to clean the lip of the flue, a spot where ash and debris can build up. The chimney must also be equipped with a clean-out door or other access at its base to remove the debris. But, more importantly, to allow access to the pull cables.

All of the parts are rust-resistant to keep them from deteriorating inside the chimney. The brush and cable can be stored in the chimney, below a wood stove, furnace, or other heating device. The present invention provides a simple way for homeowners to maintain chimneys themselves without the expense of hiring a professional.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A chimney sweep provided by building a cleaning system right into a chimney that can be used from both inside and outside of a house, said chimney sweep comprising, in combination:

a square support bracket formed by three straight sidewalls and one securing sidewall, a fastening means coupled with the securing sidewall to securely fasten the square support bracket to a top of a chimney, four gussets, each of which welded to an angle of the square support bracket, the four gussets adapted to engage a top surface of the chimney, the four gussets serving to prevent the square support bracket from sliding down the chimney;

two diagonal elongated supports, each diagonal support having a first end and a second end, each first end pivotally secured to an opposite corner of the square support bracket, each second end pivotally secured above the square support bracket via an upper pivotal element, the upper pivotal element having a lower section disposed therebelow;

a pulley system comprising a pulley element securely coupled with the lower section of the upper pivotal element, a cable having a first end, a second end, and an intermediate extent therebetween, the intermediate extent located within the pulley element;

a hollow brush attachment having an upper support and a lower support, the upper support secured to the first end of the cable of the pulley system by a fastening means, the lower support secured to the second end of the cable of the pulley system by a fastening means, the square brush attachment having a series of rigid bristles thereattached; and a wind vane having a mounting bracket, the mounting bracket secured to the upper pivotal element, the wind vane serving to enhance beauty of the device.

2. The device as described in claim 1 and further comprising:

wherein the hollow brush attachment is a round brush attachment.

3. The device as described in claim 1 and further comprising:

wherein the hollow brush attachment is a rectangular attachment.

4. The device as described in claim 1 and further comprising:

wherein each sidewall of the square support having a right section, a left section, and an intermediate section therebetween, oblong apertures formed in each right section and each left section, each intermediate section having a right edge and a left edge, a bolt secured to each right edge and each left edge, each bolt adjustably coupled with each oblong aperture of each right section and each left section, each bolt functioning to enable adjustment of each sidewall of the square support bracket to better fit a chimney.

5. A chimney sweep comprising:

a square support bracket, a fastening means securely fastens the square support bracket to a top of a chimney, four gussets, each of which welded to an angle of the square support bracket, the four gussets adapted to engage a top surface of the chimney, the four gussets serving to prevent the square support bracket from sliding down the chimney;

two diagonal elongated supports, each diagonal support having a first end and a second end, each first end pivotally secured to an opposite corner of the square support bracket, each second end pivotally secured above the center of the square support bracket via an upper pivotal element;

a pulley system securely coupled with the upper pivotal element, said pulley system including a cable having a first end and a second end;

a hollow brush attachment having an upper support and a lower support, the upper support secured to the first end of the cable of the pulley system, the lower support secured to the second end of the cable of the pulley system, the hollow brush attachment having a series of rigid bristles thereattached.

* * * * *